US006199321B1

(12) United States Patent
Ginzel

(10) Patent No.: US 6,199,321 B1
(45) Date of Patent: Mar. 13, 2001

(54) HOUSINGS FOR AUTOMATIC DOOR MECHANISMS, REVOLVING DOORS, SENSOR STRIPS, SENSOR STRIPS WITH INTEGRATED RAILS, AND SLIDING DOOR DRIVE SYSTEMS HAVING A FASTENING SYSTEM FOR END CAPS OF THE HOUSINGS, WHICH HOUSINGS ARE FORMED BY SECTIONS

(75) Inventor: Lothar Ginzel, Schwerte (DE)

(73) Assignee: Dorma GmbH +Co. KG, Ennepetal (DE)

( * ) Notice: Subject to any disclaimer, the term of this patent is extended or adjusted under 35 U.S.C. 154(b) by 0 days.

(21) Appl. No.: 09/415,334

(22) Filed: Oct. 8, 1999

Related U.S. Application Data

(63) Continuation-in-part of application No. PCT/EP99/00822, filed on Feb. 9, 1999.

(30) Foreign Application Priority Data

Feb. 9, 1998 (DE) ..... 198 04 801

(51) Int. Cl.[7] ..... E05F 15/02
(52) U.S. Cl. ..... 49/27

(58) Field of Search ..... 49/26, 27, 28, 49/403; 200/61.43

(56) References Cited

U.S. PATENT DOCUMENTS

| | | | | |
|---|---|---|---|---|
| 4,858,272 | | 8/1989 | Ogawa et al. . | |
| 5,079,417 | * | 1/1992 | Strand | 49/27 X |
| 5,438,798 | * | 8/1995 | Plamper et al. | 49/28 |
| 5,839,227 | * | 11/1998 | Gardner | 49/27 |
| 5,921,028 | * | 7/1999 | Marocco | 49/403 |
| 5,962,825 | * | 10/1999 | Miller | 200/61.43 |

FOREIGN PATENT DOCUMENTS

| | | |
|---|---|---|
| 19642275 | 4/1998 | (DE) . |
| 0544134 | 6/1993 | (EP) . |

* cited by examiner

*Primary Examiner*—Jerry Redman
(74) *Attorney, Agent, or Firm*—Nils H. Ljungman & Associates

(57) ABSTRACT

A fastening of end caps to housings that are made of profiles and are used for door-specific devices on automatically operated doors. The end caps are thereby invisibly clipped or clipped in a concealed manner onto installation elements that have previously been connected with the sections, whereby at least one of the installation elements is simultaneously used as a fastening for the housing.

1 Claim, 4 Drawing Sheets

HOUSINGS FOR AUTOMATIC DOOR MECHANISMS, REVOLVING DOORS, SENSOR STRIPS, SENSOR STRIPS WITH INTEGRATED RAILS, AND SLIDING DOOR DRIVE SYSTEMS HAVING A FASTENING SYSTEM FOR END CAPS OF THE HOUSINGS, WHICH HOUSINGS ARE FORMED BY SECTIONS

CONTINUING APPLICATION DATA

This application is a Continuation-In-Part application of International Patent Application No. PCT/EP99/00822, filed on Feb. 9, 1999 which claims priority from Federal Republic of Germany Patent Application No. 198 04 801.7, filed on Feb. 9, 1998. International Application No. PCT/EP99/00822 was pending as of the filing date of the above-cited application. The United States was an elected state in International Application No. PCT/EP99/00822.

BACKGROUND OF THE INVENTION

1. Field of the Invention

The present invention relates to a fastening of end caps to housings, whereby the end caps are connected in a substantially concealed manner to the housing by means of latching connections, which housings are made of sections or profiles and are used for door-specific devices for automatically operated doors. These doors are in particular revolving doors, sensor strips, sensor strips with integrated rails, sliding door drive systems, etc.

2. Background Information

European Patent No. 0 544 134 A1 describes a cover hood that is invisibly attached to the ends of a housing. This housing takes place by means of catches that are realized in the form of embossed areas, whereby the end caps simultaneously have matching catch recesses, and can thus be fastened to the housing without the need for tools. The end caps are thereby attached from above and are locked to the housing.

Particularly on housings that are made of extruded materials and are thereby manufactured in one piece, where possible, and the external appearance of which is important, there is not enough room for a fastening of the conventional type, namely by screws inside the section. Moreover, it is often difficult to fasten such sections satisfactorily, because they must be cut to a wide variety of lengths, depending on the specific application. The conventional type of fastening is also difficult and time consuming to install, which results in high installation costs because, among other things, it is not always possible to drill through the sections.

OBJECT OF THE INVENTION

An object of the present invention is to remedy the deficiencies of the known art and to find a type of fastening that can be used independently of the length of the section, and simultaneously makes possible an invisible or unseen fastening of the end caps and of the housing.

In other words, an object of the present invention is to develop an improved type of fastening for end caps of housings, which fastening can be used regardless of the size or length of a housing section and which can permit a substantially concealed connection between the end caps and the housing.

SUMMARY OF THE INVENTION

The present invention teaches that this object of the present invention can be accomplished by end caps that are clipped on by means of installation elements that are connected with the housing. At least one of the installation elements can be simultaneously used as a fastening for the housing. Further embodiments according to the present invention are discussed in the features hereinbelow. The end caps thereby can be fastened invisibly or in a substantially concealed manner by means of interposed installation elements that are clipped inside the section (housing), and the section is thereby simultaneously affixed to the installation site. The installation elements thereby can be realized so that they are squeezed in chambers or between webs that are present in the housing section. This squeezing can be accomplished, for example, by making parts of the cross section of the installation elements flexible, so that they can be inserted inside the terminal portion of the housing section. On at least one of the installation elements, there can also be a fastening leg that makes possible an installation and thus simultaneously a fastening of the overall section to the installation site. This fastening can be accomplished by means of a boring that is located inside the fastening leg.

An additional installation element can be connected in a different manner, for example, with the end side of the section, for which purpose the screw channels present inside the profile can be used. At the same time, an installation element can be shaped so that it simultaneously realizes or forms a cable strain relief grip. This can be accomplished, for example, if the installation element has a slot that ends in a boring. In this case, the slot must be in the area in which the installation boring is located for fastening in the screw channel. At the same time, locking fixtures can be shaped onto this installation element that can interact with locking fixtures or projections in the end caps, so that it may only be necessary to push on the end cap. To essentially guarantee an even more secure seating, projections can also be formed on the end cap, which projections are shaped so that they match the shape of the walls inside the section and thus prevent the end caps from falling off once they have been clipped on. If it becomes necessary to remove the end caps, the removal can be done preferably without tools, just like the attachment, because essentially all that is necessary is to pull the end caps off.

The above discussed embodiments of the present invention will be described further hereinbelow with reference to the accompanying figures. When the word "invention" is used in this specification, the word "invention" includes "inventions," that is, the plural of "invention." By stating "invention," the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below with reference to at least one possible exemplary embodiment as illustrated in the accompanying drawings.

DESCRIPTION OF THE PREFERRED EMBODIMENT

Figure 1:
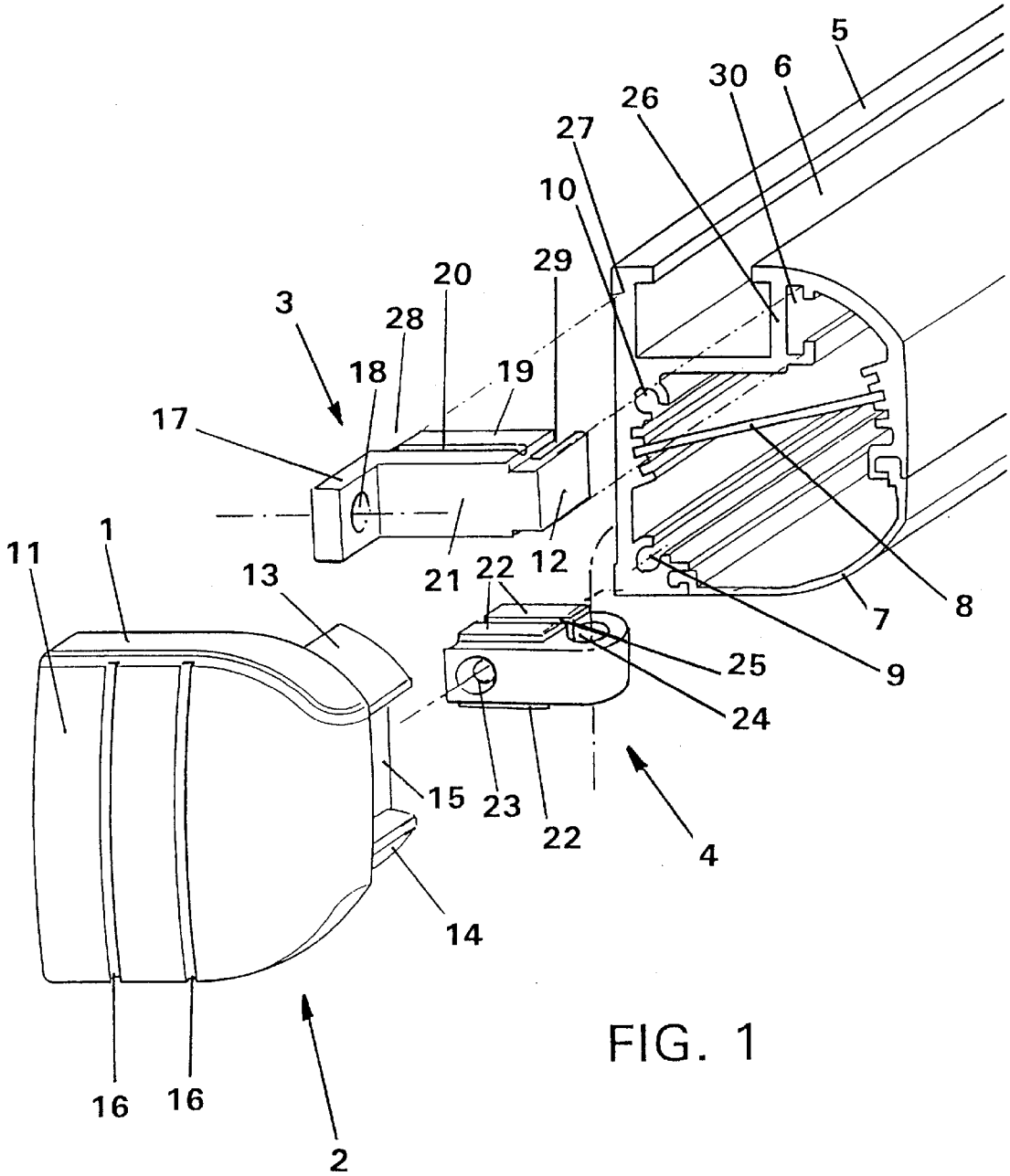
FIG. 1 shows a diagram of an end cap with fasteners.

The exemplary embodiment illustrated in FIG. 1 shows a housing 5, which is realized in the form of a section of a sensor strip with an integrated rail in the form of a chamber or channel 6. The housing 5 has internal provisions for the installation of electronic circuit boards 8, so that the radiation, e.g. infrared, of such a sensor can be emitted through an aperture 7 in the contour. There are also screw channels 9, 10 that run in the housing 5 in the longitudinal direction.

In this exemplary embodiment, two different installation elements 3, 4 are shown, to illustrate the universal fastening capabilities of the end caps 2.

The installation element 3 comprises essentially a fastening leg 17 which is penetrated by a fastening boring 18. By means of the fastening boring 18, the installation element 3 with the sensor strip, namely the housing 5, fastened to it, is fastened to each end side, e.g. on a door or above the door. A bracket 21 is at an angle of approximately 90 degrees with respect to the fastening leg 17. On the bracket 21, there are flexible or spring legs 19 with dimensions such that they can be inserted into the chamber 6 of the housing 5. At the same time, however, and in the same direction as the spring legs 19, there is a web 12 that is separated from the spring legs 19 by a recess 29. The recess 29 is approximately as wide as the web 26 which is inside the housing 5. It is thereby possible to insert the web 12 inside an additional chamber 30 of the housing 5. So that the two tabs, i.e. the spring legs 19 and the web 12, can also be inserted properly into the housing 5, in the terminal area, for example, i.e. near the support 21, there is a tapered cross section 20 which makes it apply a certain bias to the spring legs 19. To get past a leg 27 of the section 30 on the installation side during the insertion process, there is a recess 28 on the installation element 3, so that the back side of the fastening leg 17 also lies flat at the installation site.

Figure 4:
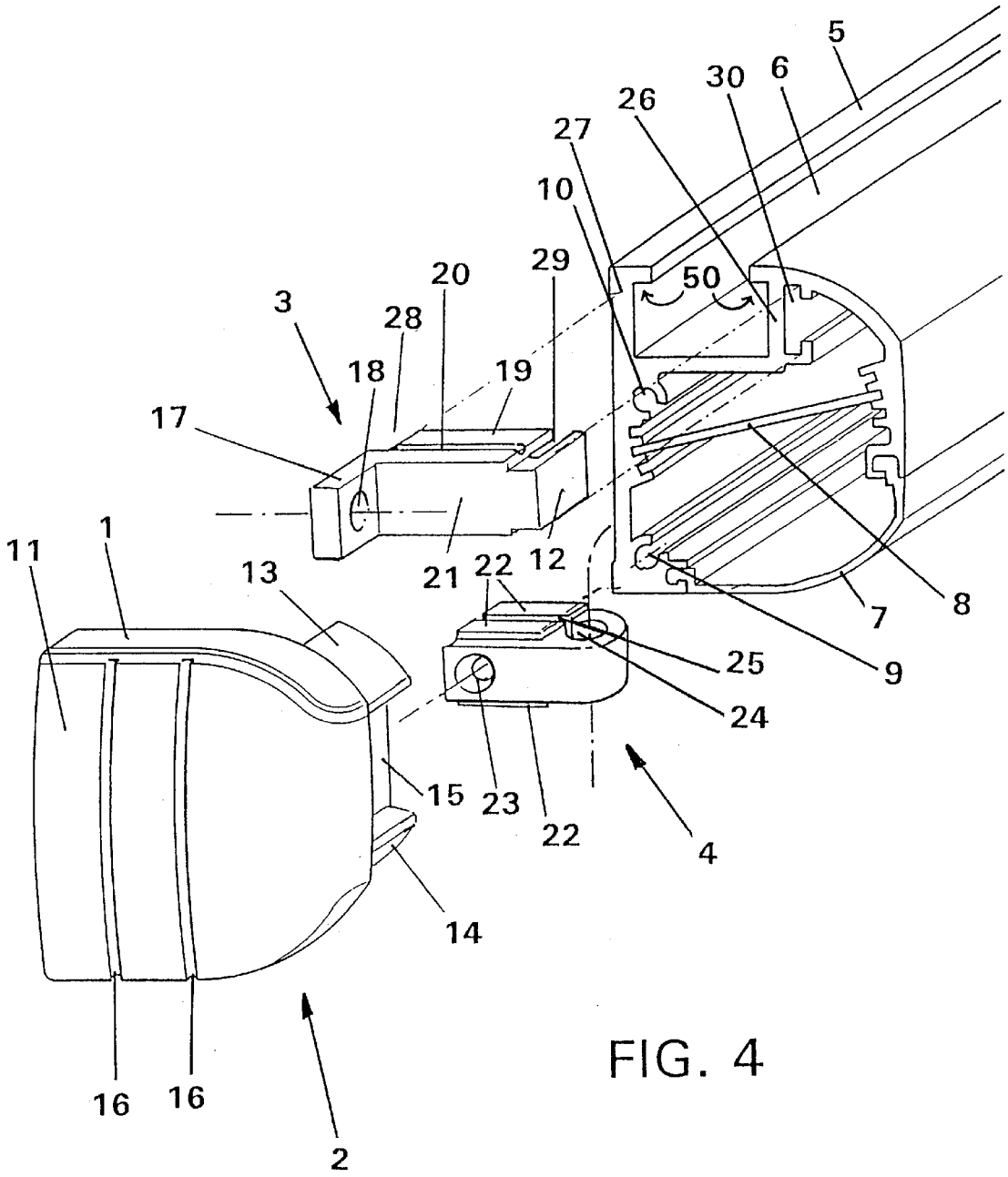
FIG. 4 shows the diagram as in FIG. 1, but with interior sides of the chamber or channel.

To further explain, in at least one embodiment according to the present invention, the installation element 3 comprises spring legs 19. The installation element further has a tapered section 20 which is positioned immediately adjacent the spring legs 19. The tapered section can apply a biasing force to the spring legs 19. The spring legs 19 can be inserted into the channel 6 of the housing 5. The biasing force from the tapered section 20 can, according to at least one embodiment of the present invention, cause the spring legs 19 to exert a force or press upwardly against the interior sides 50 of the upper portion of the channel 6, as can be seen in FIG. 4. Additionally, the installation element 3 can comprise a fastening boring 18 to permit the fastening of the installation element 3 and the housing section 5 connected to it to a wall or other mounting structure for automatic doors. A screw, bolt, pin or other such fastening piece can be placed through the fastening bore 18 to affix the installation element 3 and its corresponding housing section 5 to the wall or mounting structure.

The second installation element 4 is realized in a different manner, and thereby performs an additional function besides the locking with the end cap 2. This installation element 4 is bolted by means of a fastening boring 23 in the bolt channel 9 by means of a bolt element (not shown) to the housing 5. At the same time, however, the installation element 4 is shaped so that approximately in the middle it has a slot 25 that ends inside a cable duct 24, in the form of a boring. When the screws in the screw channel 9 are tightened, the two legs that are formed by the slot 25 on the installation element 4 are pressed together, and a cable strain relief grip for the cable that is led in through the cable duct 24 is also essentially guaranteed. On the side of the installation element 4 there are projecting latching fixtures 22, which in turn interact with correspondingly shaped webs or latching fixtures that are not shown in the exemplary embodiment illustrated, but are located inside the end cap 2.

If, after the sensor strip has been installed, the end cap 2 is to be clipped on by means of the installation element 3 and the fastening of the installation element 4, this operation can be performed essentially without the use of tools. On one hand, the end cap 2 locks in the cross section taper 20, and on the other hand in the latching fixtures 22. To further essentially guarantee a secure attachment, there are also projections 13, 14 on the end cap 2 which are interrupted by a recess 15. These projections 13, 14 are shaped so that there is a substantially exact fit with the contour of the housing 5. So that the end cap can also be fitted to create an attractive external appearance as illustrated in the exemplary embodiment, one side wall 11 is realized in a slightly curved manner, whereby this side wall is interrupted by simulated joints 16. The side walls 1 also run in the same contour as the section 5.

The invention makes possible a simple, secure and economical fastening, e.g. of sections, and also essentially guarantees that the end caps can be installed and removed without the need for tools.

Figure 2:
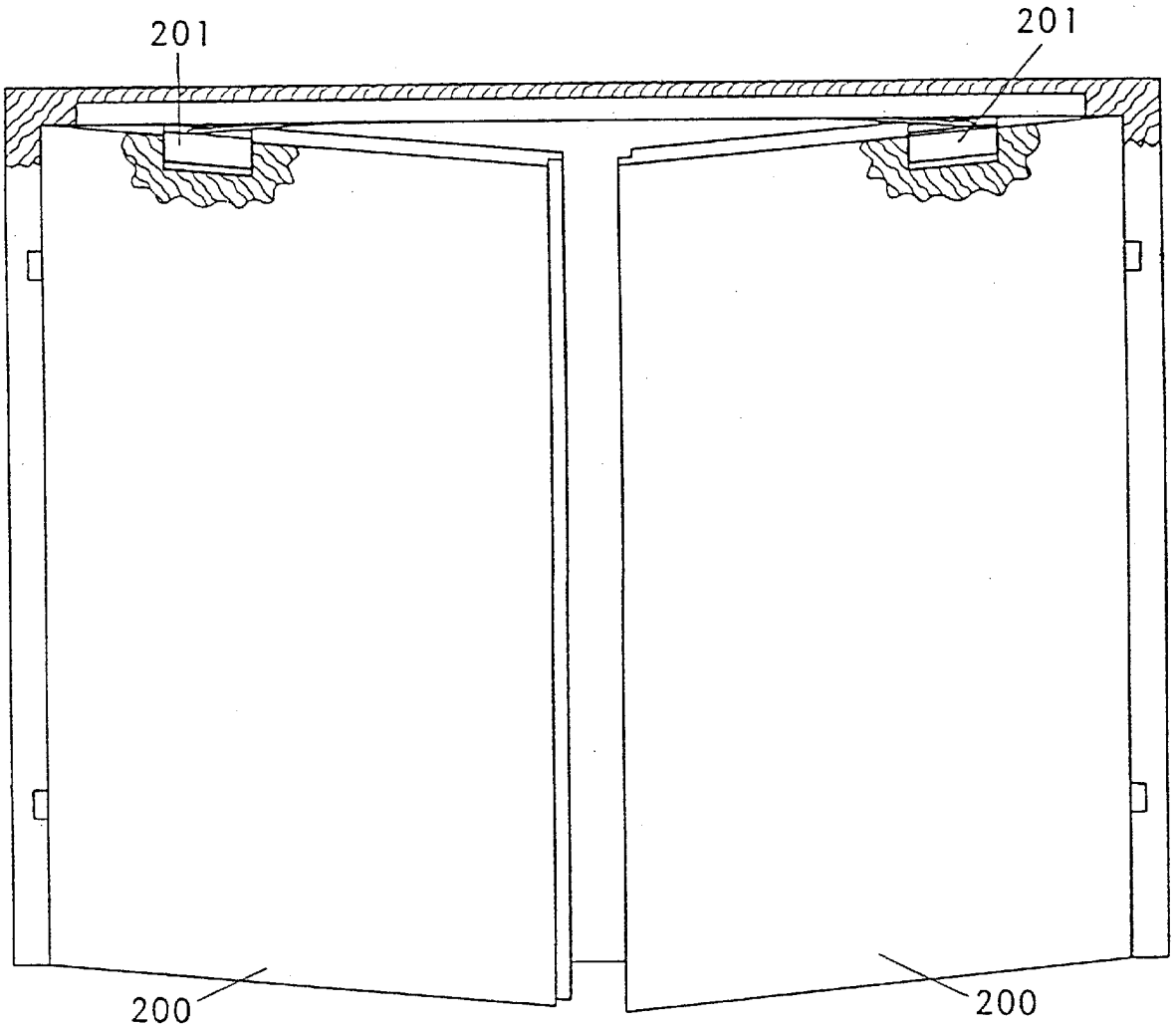
FIG. 2 shows a door system having a housing with end caps according to at least one embodiment of the present invention.

FIG. 2 shows a door system having door panels 200 and closing devices 201. The housing 5 can be located adjacent the upper portion of the door system, according to at least one embodiment of the present invention.

Figure 3:
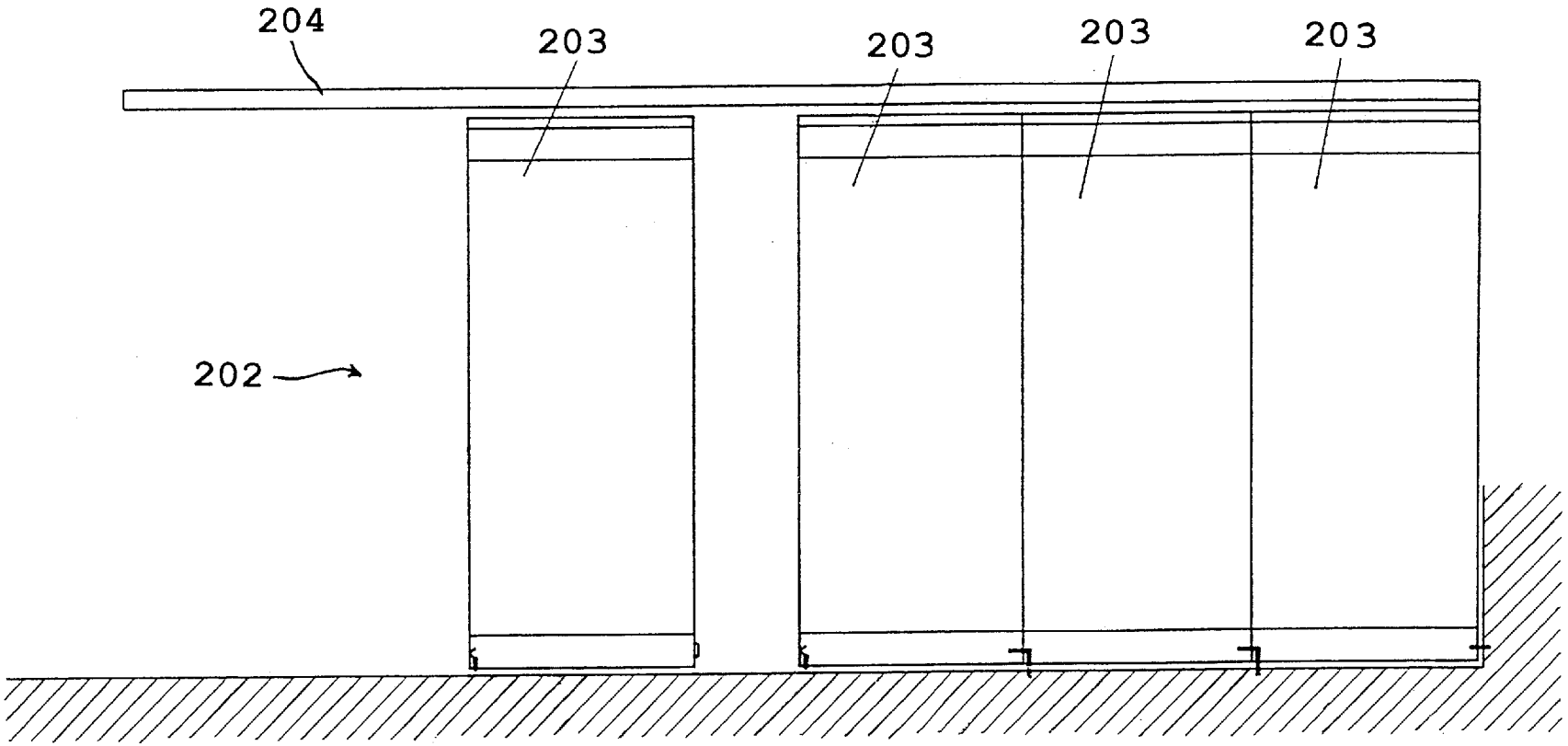
FIG. 3 shows a movable partition system having a housing with end caps according to at least one embodiment of the present invention.

FIG. 3 shows a movable partition system 202 having movable partitions 203 and a guide rail 204. The housing 5 can be located adjacent to the guide rail 204, according to at least one embodiment of the present invention.

One feature of the invention resides broadly in the fastening of end caps to housings that are made of profiles and are used for door-specific devices on automatically operated doors, whereby the end caps are invisible connected to the housing by means of latching connections, characterized by the fact that the end caps 2 are clipped on by means of installation elements 3, 4 that are connected with the housing 4, whereby at least one of the installation elements 3, 4 is simultaneously used as a fastening for the housing 5.

Another feature of the invention resides broadly in the fastening characterized by the fact that the installation element 3 is realized so that it is inserted into chambers or between webs of the housing 5, and there is simultaneously a fastening leg 17 that has at least one boring 18, through which the installation of the housing 5 with the installation element 3 can be accomplished.

Yet another feature of the invention resides broadly in the fastening characterized by the fact that the installation element 4 is connected to the housing 5 by a fastening boring 23 by means of a screw channel 9.

Still another feature of the invention resides broadly in the fastening characterized by the fact that on the installation elements 3, 4 there are projections and/or depressions that interact with projections and/or depressions in the end caps 2 to cause a locking of the end caps with the housing 5.

A further feature of the invention resides broadly in the fastening characterized by the fact that the end caps 2 have projections 13, 14 which are engaged inside webs etc. that are located inside the housing 5.

Another feature of the invention resides broadly in the fastening characterized by the fact that the installation element 4 has a cable strain relief grip.

Yet another feature of the invention resides broadly in the fastening characterized by the fact that the end caps 2 have an external contour that matches the shape of the housing 5 and are made of plastic.

Still another feature of the invention resides broadly in the fastening characterized by the fact that the installation elements 3, 4 are made of plastic or light alloy metal.

A further feature of the invention resides broadly in the fastening characterized by the fact that the housing 5 is made of plastic or aluminum or of a combination of these two materials.

Another feature of the invention resides broadly in the fastening characterized by the fact that the housing 5 is a housing of a revolving door drive system.

Yet another feature of the invention resides broadly in the fastening characterized by the fact that the housing 1 is a housing of a sensor strip.

Still another feature of the invention resides broadly in the fastening characterized by the fact that the housing 5 is a housing of a sensor strip with an integrated rail.

A further feature of the invention resides broadly in the fastening characterized by the fact that the housing 5 is a housing of a sliding door drive system.

U.S. application Ser. No. 09/415,340, having a filing date of Oct. 8, 1999, inventor Andreas Finke, and attorney docket No. NHL-DOR-61, entitled "HOUSING FOR AUTOMATIC DOOR MECHANISMS HAVING A HINGED CONNECTION" and claiming priority from International Application No. PCT/EP99/00808, filed on Feb. 8, 1999 and Federal Republic of Germany Patent Application No. 198 04 859, filed on Feb. 9, 1998, and U.S. application Ser. No. 09/415,340, having a filing date of Oct. 8, 1999, inventors Andreas Finke and Andreas Althoff, and attorney docket No. NHL-DOR-63, entitled "HOUSING FOR AUTOMATIC DOOR MECHANISMS" and claiming priority from International Application No. PCT/EP99/00811, filed on Feb. 8, 1999 and Federal Republic of Germany Patent Application No. 198 04 860.2, filed on Feb. 9, 1998 are hereby incorporated by reference as if set forth in their entirety herein.

Some examples of housing or access panels which may be utilized or incorporated in an embodiment of the present invention may be found in the following U.S. Pat. No. 5,327,682, issued on Jul. 12, 1994.

Some examples of guide rails or guide rail arrangements for door, wall or partition systems which may be utilized or incorporated in an embodiment of the present invention may be found in the following U.S. Pat. No. 5,538,064, issued to inventor Salice on Jul. 23, 1996; U.S. Pat. No. 5,327,681, issued to inventor Minami on Jul. 12, 1994; U.S. Pat. No. 4,555,828, issued to inventor Matimura on Dec. 3, 1985; and U.S. Pat. No. 4,084,289, issued to inventor Naimo on Apr. 18, 1978.

Some examples of doors, foldable doors, or door systems and devices for their operation which may be utilized or incorporated in an embodiment of the present invention may be found in the following U.S. Pat. No. 5,762,123, issued to inventors Kuyama, et al. on Jun. 9, 1998; U.S. Pat. No. 5,651,216, issued to inventor Tillmann on Jul. 29, 1997; U.S. Pat. No. 5,186,230, issued to inventor Ostrander on Feb. 16, 1993; U.S. Pat. No. 5,165,142, issued to inventor Pilsbury on Nov. 24, 1992; U.S. Pat. No. 5,099,903, issued to inventor Chen on Mar. 31, 1992; U.S. Pat. No. 5,070,926, issued to inventor Behring on Dec. 10, 1991; and U.S. Pat. No. 4,932,455, issued to inventor Yamada on Jun. 12, 1990.

Some examples of movable partition or wall systems and devices for their operation which may be utilized or incorporated in an embodiment of the present invention may be found in the following U.S. Pat. No. 5,930,953, issued to inventor Estfeller on Aug. 3, 1999; U.S. Pat. No. 5,730,027, issued to inventor Hormann on Mar. 24, 1998; U.S. Pat. No. 5,461,829, issued to inventors Lehto, et al. on Oct. 31, 1995; U.S. Pat. No. 5,404,675, issued to inventor Schmidhauser on Apr. 11, 1995; U.S. Pat. No. 5,329,857, issued to inventor Owens on Jul. 19, 1994; U.S. Pat. No. 5,295,281, issued to inventor Kordes on Mar. 22, 1994; U.S. Pat. No. 5,394,648, issued to inventor Kordes on Mar. 7, 1995; U.S. Pat. No. 5,417,013, issued to inventor Tillman on May 23, 1995; U.S. Pat. No. 5,544,462, issued to inventor Kordes on Aug. 13, 1996; U.S. Pat. No. 5,406,761, issued to inventors Hobbiebrunken, et al. on Apr. 18, 1995; U.S. Pat. No. 5,152,332, issued to inventor Siener on Oct. 6, 1992; U.S. Pat. No. 5,042,555, issued to inventor Owens on Aug. 27, 1991; U.S. Pat. No. 4,934,119, issued to inventor Ybarra on Jun. 19, 1990; U.S. Pat. No. 4,914,878, issued to inventors Tamaki, et al. on Apr. 10, 1990; U.S. Pat. No. 4,895,246, issued to inventor Rizzi on Jan. 23, 1990; U.S. Pat. No. 4,752,987, issued to inventors Dreyer, et al. on Jun. 28, 1988; U.S. Pat. No. 4,596,094, issued to inventors Teller, et al. on Jun. 24, 1986; U.S. Pat. No. 4,555,828, issued to inventor Matimura on Dec. 3, 1985; U.S. Pat. No. 4,458,462, issued to inventor Schold on Jul. 10, 1984; U.S. Pat. No. 4,404,770, issued to inventor Markus on Sep. 20, 1983; and U.S. Pat. No. 4,112,647, issued to inventor Scheid on Sep. 12, 1978.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 198 04 801.7, filed on Feb. 9, 1998, having inventor Lothar Ginzel, and DE-OS 198 04 801.7 and DE-PS 198 04 801.7 and International Application No. PCT/EP99/00822, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

AT LEAST PARTIAL NOMENCLATURE

1 Curved side wall
2 end cap
3 installation element
4 installation element
5 housing (section)
6 chamber
7 aperture
8 circuit board
9 screw channel
10 screw channel
11 side wall
12 web
13 projection
14 projection
15 recess
16 simulated joint
17 fastening leg
18 fastening boring
19 spring leg
20 tapered cross section
21 support
22 latching fixture
23 fastening boring
24 cable lead-through
25 slot
26 web
27 leg
28 recess
29 indentation
30 chamber

What is claimed is:

1. An automatic door system, said automatic door system comprising:

at least one movable partition;

a housing;

said housing being configured to contain components for automatic operation of said automatic door system;

end caps;

said end caps comprising at least two connection elements;

said end caps being configured and disposed to be connected in a concealed manner to said housing by said at least two connecting elements;

a mounting structure;

said housing being configured to be mounted on said mounting structure;

said mounting structure being connected to a stationary building structure; and at least one of said at least two connection elements being configured and disposed to fasten said housing to said mounting structure.

* * * * *